US007434911B2

(12) United States Patent
Brookmire et al.

(10) Patent No.: US 7,434,911 B2
(45) Date of Patent: Oct. 14, 2008

(54) SYSTEM AND METHOD TO HIDE DIE-TO-DIE BOUNDARY BANDING DEFECTS IN A DRUM PRINTER

(75) Inventors: Michael Brookmire, Washougal, WA (US); Weiyun Sun, Vancouver, WA (US); Hsue-Yang Liu, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 346 days.

(21) Appl. No.: 11/044,123

(22) Filed: Jan. 27, 2005

(65) Prior Publication Data

US 2006/0164492 A1 Jul. 27, 2006

(51) Int. Cl.
*B41J 2/155* (2006.01)

(52) U.S. Cl. ..... 347/42; 347/12; 347/13

(58) Field of Classification Search ..... 347/5, 347/12, 42, 102, 104, 35, 13, 9
See application file for complete search history.

(56) References Cited

U.S. PATENT DOCUMENTS 5,771,054 A * 6/1998 Dudek et al. ..... 347/102
6,070,977 A * 6/2000 Nuita et al. ..... 347/104
6,089,693 A 7/2000 Drake
6,312,099 B1 * 11/2001 Hawkins et al. ..... 347/42
6,450,614 B1 9/2002 Scheffelin
7,029,095 B2 * 4/2006 Tsuboi et al. ..... 347/35
2002/0024557 A1 2/2002 Matsumoto

FOREIGN PATENT DOCUMENTS

EP 1238805 9/2002

OTHER PUBLICATIONS

International Search Report and Written Opinion by the International Searching Authority dated Aug. 14, 2006.

* cited by examiner

*Primary Examiner*—Lam S Nguyen

(57) ABSTRACT

Exemplary embodiments of the invention include systems and methods of reducing visible print defects in drum printers having multi-die printheads oriented substantially perpendicular to the print media path. The exemplary embodiments include printing very small amounts of additional ink via empirically determined printing masks in addition to the normal image content, such that the print defects become less visible. Further exemplary embodiments include printing the additional ink during times typically utilized for print drying.

31 Claims, 5 Drawing Sheets

SYSTEM AND METHOD TO HIDE DIE-TO-DIE BOUNDARY BANDING DEFECTS IN A DRUM PRINTER

FIELD OF THE INVENTION

This invention relates generally to methods of minimizing print quality defects in drum printers having multiple-die printhead assemblies.

BACKGROUND

Inkjet printers are well known in the art. Small droplets of liquid ink, propelled by thermal heating, piezoelectric actuators, or some other mechanism, are deposited by a printhead on a print media, such as paper.

In scanning-carriage inkjet printing systems, inkjet printheads are typically mounted on a carriage that is moved back and forth across the print media. As the printheads are moved across the print media, a control system activates the printheads to deposit or eject ink droplets onto the print media to form text and images. The print media is generally held substantially stationary while the printheads complete a "print swath", typically an inch or less in height; the print media is then advanced between print swaths. The need to complete numerous carriage passes back and forth across a page has meant that inkjet printers have typically been significantly slower than some other forms of printers, such as laser printers, which can essentially produce a page-wide image.

The ink ejection mechanisms of inkjet printheads are typically manufactured in a manner similar to the manufacture of semiconductor integrated circuits. The print swath for a printhead is thus typically limited by the difficulty in producing very large semiconductor chips or "die". Consequently, to produce printheads with wider print swaths, other approaches are used, such as configuring multiple printhead die in a printhead module, such as a "page wide array". Print swaths spanning an entire page width, or a substantial portion of a page width, can allow inkjet printers to compete with laser printers in print speed.

Using multiple printhead die in a printhead assembly can create other problems, however. While the physical spacings of the ink ejection mechanisms (or "nozzles") in a single die are determined by the semiconductor manufacturing steps, which are extremely precise, the spacing between nozzles in different die within a module are subject to slight misalignments. Further, the aerodynamic effects on ink droplets ejected by nozzles near the end of a printhead die may be different than the aerodynamic effects on ink droplets ejected nearer the center of the die. These and other factors can cause visible print defects on the printed media corresponding to the boundaries between die. These print defects generally take the form of light or dark bands or streaks on the page.

Inkjet printers often utilize multiple-pass print modes to improve print quality. By applying only a portion of the total ink on each pass, less liquid is applied to page at each pass, minimizing color bleed due to mixing of inks at color boundaries and buckling or "cockle" of the print media. Multiple print passes also allow greater optical densities to be achieved in the final print. In a drum printer, each "pass" may constitute a revolution of the drum; additional revolutions may be used for drying of the printed page. Multiple pass printing typically takes longer than single pass printing, but print quality can be substantially improved.

There is a need for methods that reduce visible print defects in images produced by multiple die printhead assemblies.

SUMMARY

Exemplary embodiments of the invention include systems and methods of reducing visible print defects in drum printers having multi-die printheads oriented substantially perpendicular to the print media path. The exemplary embodiments include printing very small amounts of additional ink in a substantially pseudo-random pattern using empirically determined printing masks in addition to the normal image content, such that the print defects become less visible. Further exemplary embodiments include printing the additional ink during times typically utilized for print drying.

Other aspects and advantages of the present invention will become apparent from the following detailed description, taken in conjunction with the accompanying drawings, illustrating by way of example the principles of the invention.

DESCRIPTION OF EMBODIMENTS OF THE INVENTION

Embodiments of the invention are described with respect to an exemplary inkjet printing system; however, the invention is not limited to the exemplary system, nor to the field of inkjet printing, but may be utilized in other systems.

In the following specification, for purposes of explanation, specific details are set forth in order to provide an understanding of the present invention. It will be apparent to one skilled in the art, however, that the present invention may be practiced without these specific details. Reference in the specification to "one embodiment" or "an exemplary embodiment" means that a particular feature, structure, or characteristic described in connection with the embodiment is included in at least one embodiment. The appearance of the phrase "in one embodiment" in various places in the specification do not necessarily refer to the same embodiment.

Figure 1:
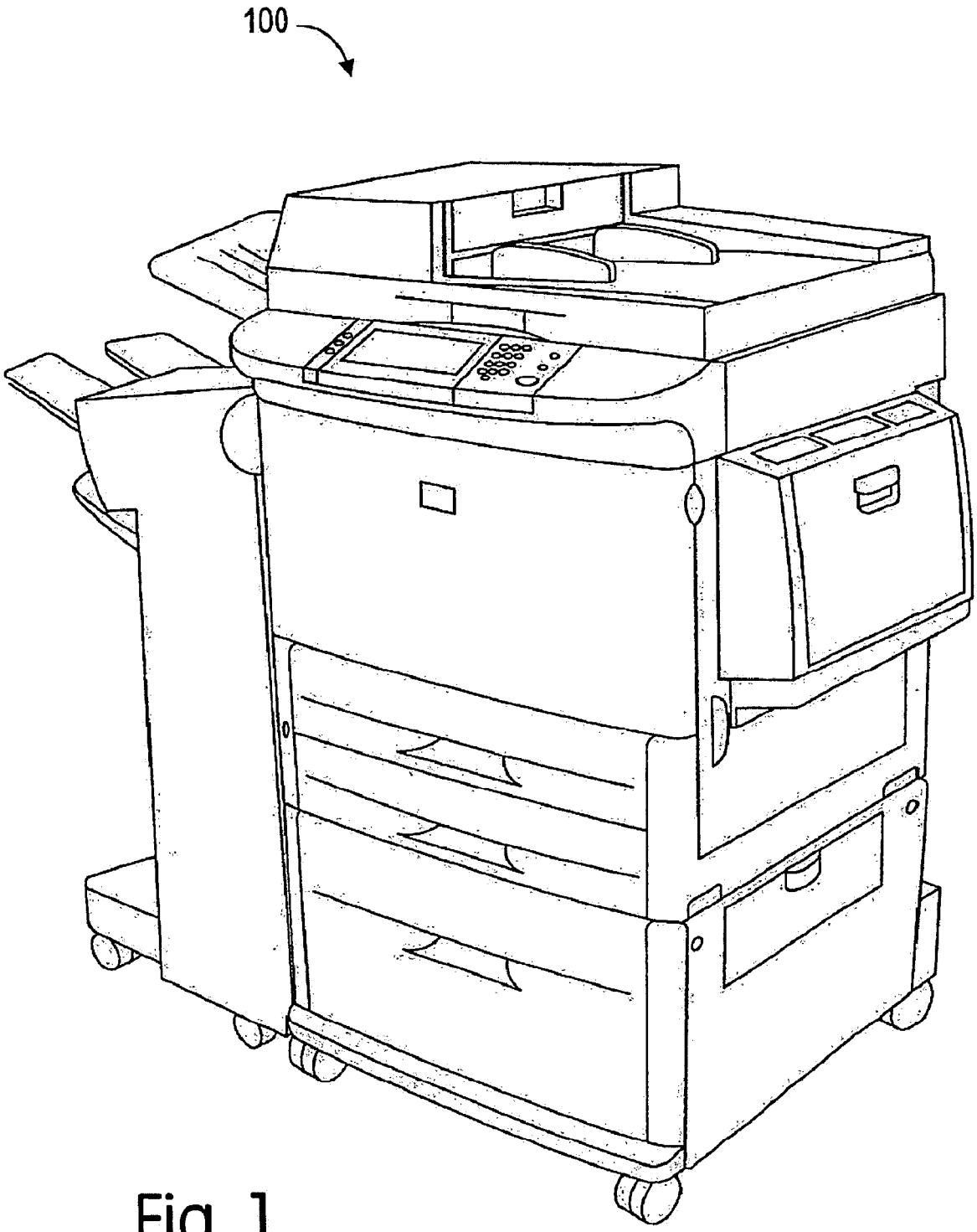
FIG. 1 illustrates an exemplary inkjet printing system in which embodiments of the invention may be utilized.

FIG. 1 illustrates an exemplary inkjet printing system 100 in which embodiments of the invention may be utilized. Intended for moderately high volume printing, the system may also include multiple other functions and may, for example, be connected to an office network to provide printing, scanning, and faxing capabilities to a workgroup.

Figure 2:
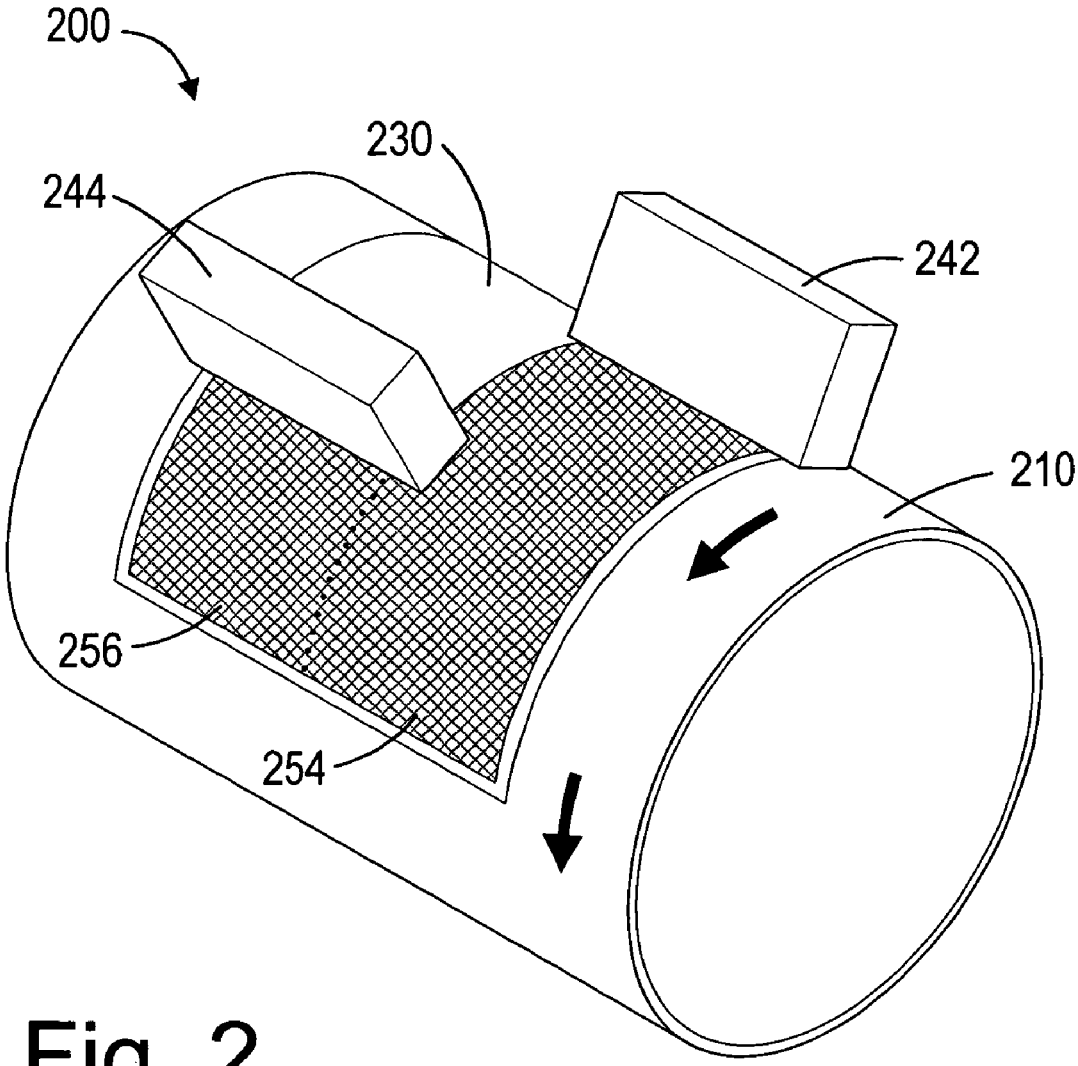
FIG. 2 illustrates the paper path and printhead mechanisms of an exemplary inkjet printing system in which embodiments of the invention may be utilized.

FIG. 2 illustrates the basic media path and printhead mechanisms 200 of an exemplary inkjet printing system in which embodiments of the invention may be utilized. As shown in FIG. 2, print media 230, such as a sheet of paper, is held to a rotating drum 210 by air suction. The print media 230 is rotated past print head assemblies 242, 244 that remain substantially stationary during the printing process. More than one printhead assembly may be utilized to span the page width as indicated; one printhead assembly 242 may print a first portion 254 of the page width, and an additional printhead assembly 244 may print a second portion 256 of the page width. Alternately, a single "page-wide" printhead may be employed, or more than two printhead assemblies may be used to span the printed page. Each printhead assembly comprises multiple printhead die arrayed along the length of the assembly, and each may print multiple primary colors, as well as black ink and a "fixer" fluid, as discussed below. Each illustrated printhead assembly 242, 244 may also comprise separate assemblies for each ink color, or multiple colors may be combined in a single assembly, as is known in the art.

In multi-pass printing, the print media 230 is held to the drum 210 by suction for more than one revolution of the drum, with the printhead assemblies 242, 244 depositing ink during each pass of the print media. The printer may include drying mechanisms (not shown) to accelerate the drying of the printed media, which may, for example, be placed near the bottom of the drum 210 such that the printed media may be at least partially dried between printing passes. The printhead assemblies 242, 244 may typically be mounted on carriages (not shown) which permit the printheads to moved side-to-side to different locations on the drum or off the drum entirely for servicing, or to reposition the printheads for different paper configurations.

The printing process of the exemplary printer of FIG. 2 may involve multiple rotations of the print media on the print drum; rotations may be used for deposition of ink or other fluids on the media, or for drying of previously deposited ink or fluids. Different sequences of fluid deposition and drying may be utilized depending on such factors as the specific characteristics of the ink and print media; the image quality desired; and the amount of fluid deposited (for example, a "dense" or dark image may require multiple print passes to incrementally build up the image without inducing "bleed" or "paper cockle," and may also require additional drying). More than one print function may be performed during a rotation, such as the deposition of additional ink or fluid during a cycle primarily dedicated to drying.

Figure 3:
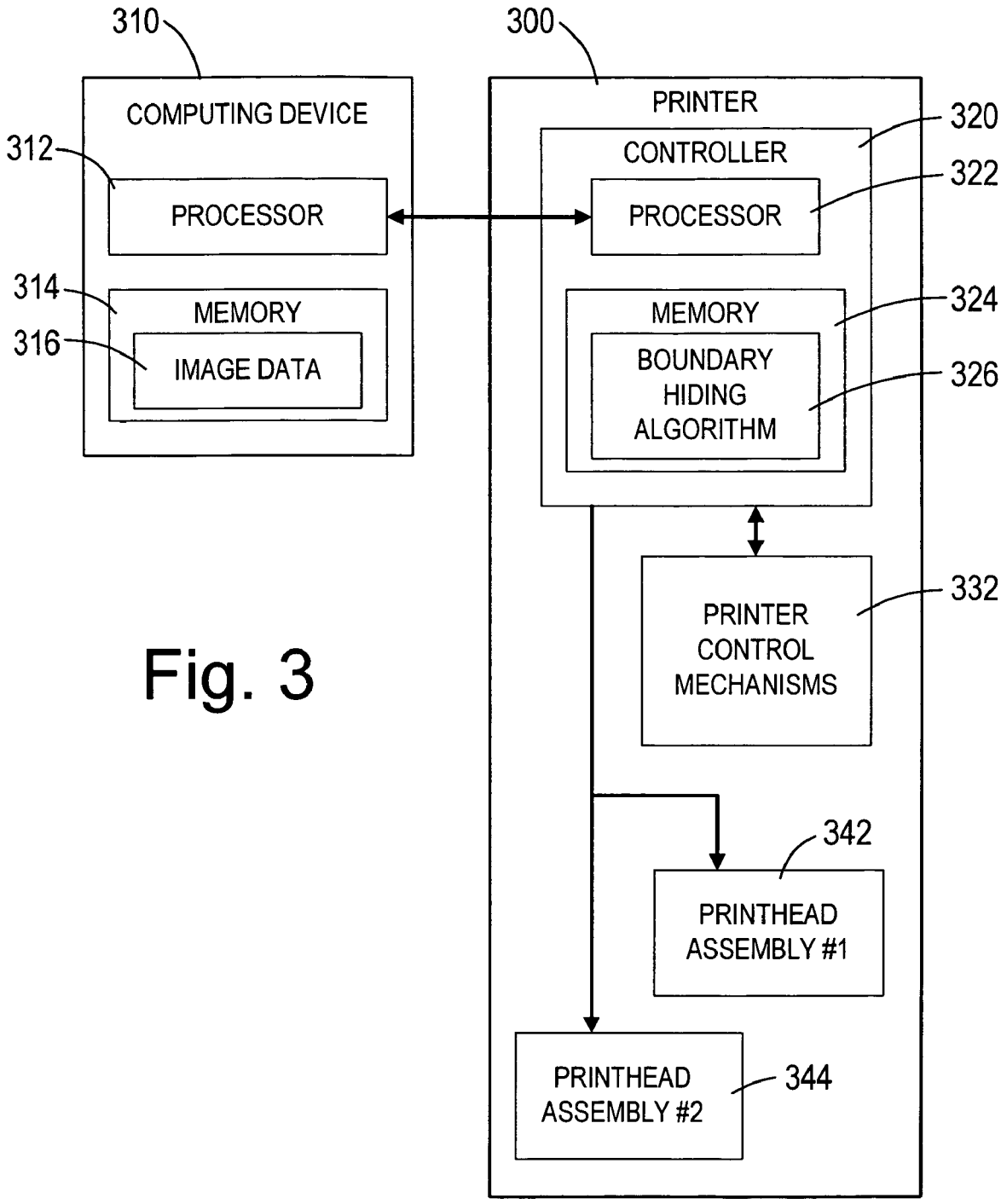
FIG. 3 is a schematic view of the exemplary inkjet printing system of FIGS. 1 and 2.

FIG. 3 is a schematic view of the exemplary inkjet printing system of FIGS. 1 and 2. Computing device 310 may be a computer directly connected to the printing system 300, or may be multiple computers accessing the printing system over a network, such as a Local Area Network (LAN). Computing device 310 typically includes a processor 312 having access to memory 314 including image data 316. The computing device 310 typically formats the image data in a form which may be utilized by printing system 300.

Printing system 300 typically includes a controller 320 which includes a processor 322 having access to memory 324. The memory may include the boundary hiding algorithm 326 of the present invention, together with other programs, parameters, and print data.

The controller 320 typically generates print data for each printhead assembly 342, 344 in the printer, and also controls other printer mechanism 332, such as, for example, controlling the drum rotation, paper feeding mechanism, and media dryers (not shown). Although two printhead assemblies are shown in FIG. 3, a different number of assemblies may be used, as discussed above. In generating print data for each of the printhead assemblies, the controller typically forms data addressing the individual print nozzles within each assembly, enabling those nozzles required to form the desired image.

Figure 4:
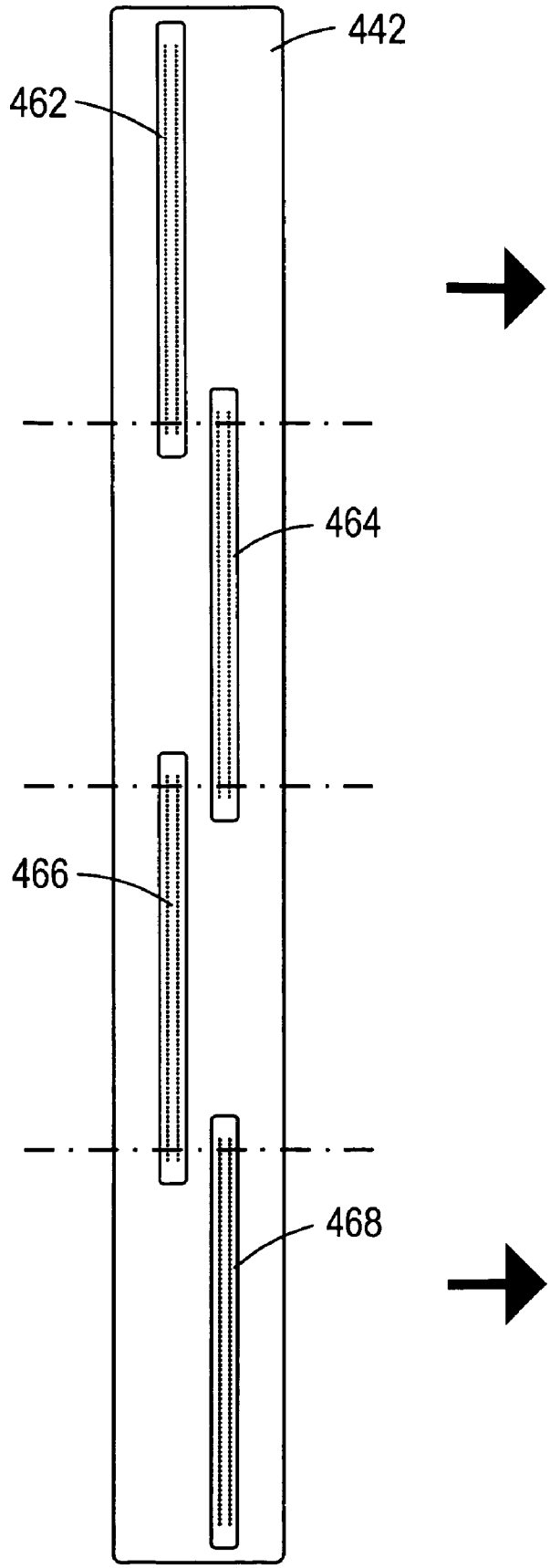
FIG. 4 illustrates in simplified form how multiple printhead die are arrayed within a printhead assembly.

FIG. 4 illustrates in simplified form how multiple printhead die 462, 464, 466, 468 are arrayed within a printhead assembly 442. Each of the printhead die 462, 464, 466, 468 is shown having two linear arrays of print nozzles, such as might be used to print two different ink colors. The individual die may be arranged in a staggered pattern perpendicular to the direction of the media transport (indicated by the arrows). As indicated by the dashed lines, each printhead die overlap the span of the adjacent die by a small margin (i.e., there is a region near the ends of adjacent die where the rows of nozzles of the adjacent die overlap).

When printing with multiple printhead die per printhead assembly, a difficult challenge is hiding the "joint" where one die stops printing and the next die starts printing. Small misalignments between in the mounting of the printhead die, as well as aerodynamic effects during printing, make hiding this joint extremely challenging. The aerodynamic effects can be particularly difficult to deal with, since the effects can vary with the type of printing being performed (e.g., in a very "dense" print, such as a photograph, the large amount of ink being deposited can cause droplets from nozzles near the end of the printhead die to be pulled back towards the center of the die). In some printing systems, the most objectionable "joint" or boundary defects at the die end boundaries have been shown to typically take the form of light-density bands on dense prints, to which the human eye is very sensitive.

Banding defects due to die boundaries can be somewhat minimized by performing a diagnostic test that determines, for an ending nozzle on a given die, what the best starting nozzle to use on the adjacent die should be in order for ink from to the two die to align on the page without a gap or an overlap. This is often called a butt joint (a term borrowed from woodworking). While in theory this straight forward solution works, and diagnostics to perform this alignment exist, in practice aerodynamics during printing cause this solution to fail. In particular, when a die is printing at a high density, airflow will tend to pull the ink from the end nozzles back towards the center of the die, leaving a white gap on the page between two adjacent die. Realigning to compensate for this effect leaves a dark line on the page where the die overlap when printing at a low density and the ink is not pulled towards the center of the die.

A more complex solution is to "dither" the output of the end nozzles on two adjacent die. That is, instead of stopping one die at a particular nozzle and starting the next die at another nozzle, all of the nozzles that overlap between the two die are used. There are many ways this can done (e.g. use every other nozzle from each die, randomly choose which nozzle from which die gets used, etc) but the end effect is to spread the joint between die out over a larger area. This solution can sometimes be effective, however, it is even more sensitive to die-to-die misalignment and is not free from the aerodynamic problems. In fact, when this solution fails, it can produce a more visible artifact than the first solution since the joint covers more physical page space.

One method that has been shown to be effective in hiding print defects of this nature is to perform multiple print passes while "indexing" the printhead assembly between passes. In indexing, the entire printhead assembly is moved slightly such that the joints between printhead die (or the location of other defects, such as faulty nozzles) fall in a different location during the subsequent printing pass. A disadvantage with physically indexing the printhead assembly is that the time required to physically move the assembly slows down the printing process.

Embodiments of the present invention address banding defects at die boundaries by printing very small amounts of additional ink, in a substantially random pattern, in the areas prone to die-to-die boundary defects. Empirically-determined image masks are used to deposit ink onto the print media during part of the multipass printing process. Since the amount of ink deposited is very small, the additional "printing" may be performed during a cycle devoted to print drying without impacting the overall print times (the types of prints in which die boundary defects are most readily apparent typically also require substantial drying, such that in a drum printer two to four "spins" may be solely devoted to drying).

It has been empirically observed that this amount of extra printing is substantially invisible to the naked eye when viewed separately on paper (in the absence of the normal printed image). When this slight addition of ink is added to the areas of the die to die boundary areas, the effect is to change the density slightly and smoothly and this area as a result blends into the normal image density to look continuous to the human eye.

In an exemplary embodiment, the print patterns are accomplished by using a programmable mask pattern. Each pass for each desired color used in these areas have uniquely different pseudo-random masks such that the dots are interleaved smoothly between passes in a random stochastic type pattern; these small masks can be "tiled" across the page for every die used. Embodiments may also utilize the pen alignment data for the individual printer to help pre-determine which colors need more attention or more hiding. Pen alignment and color calibration data may be used to determine which die boundaries look to be more misplaced, or in turn, have more objectionable boundaries, and this information can be used to trigger which colors are to be used in this extra printing of ink. The printing system may utilize any of the available colors, and may also utilize other available printing fluids, such as "fixer".

The exact mask pattern to be used can be programmable, and will typically be empirically determined based on best defect-hiding capability, which may vary based on other printing parameters. The masks may be made in any mask shape, such as tapered, double dotting, bunching, etc., to help hide the die to die defects the most robust way.

Figure 5:
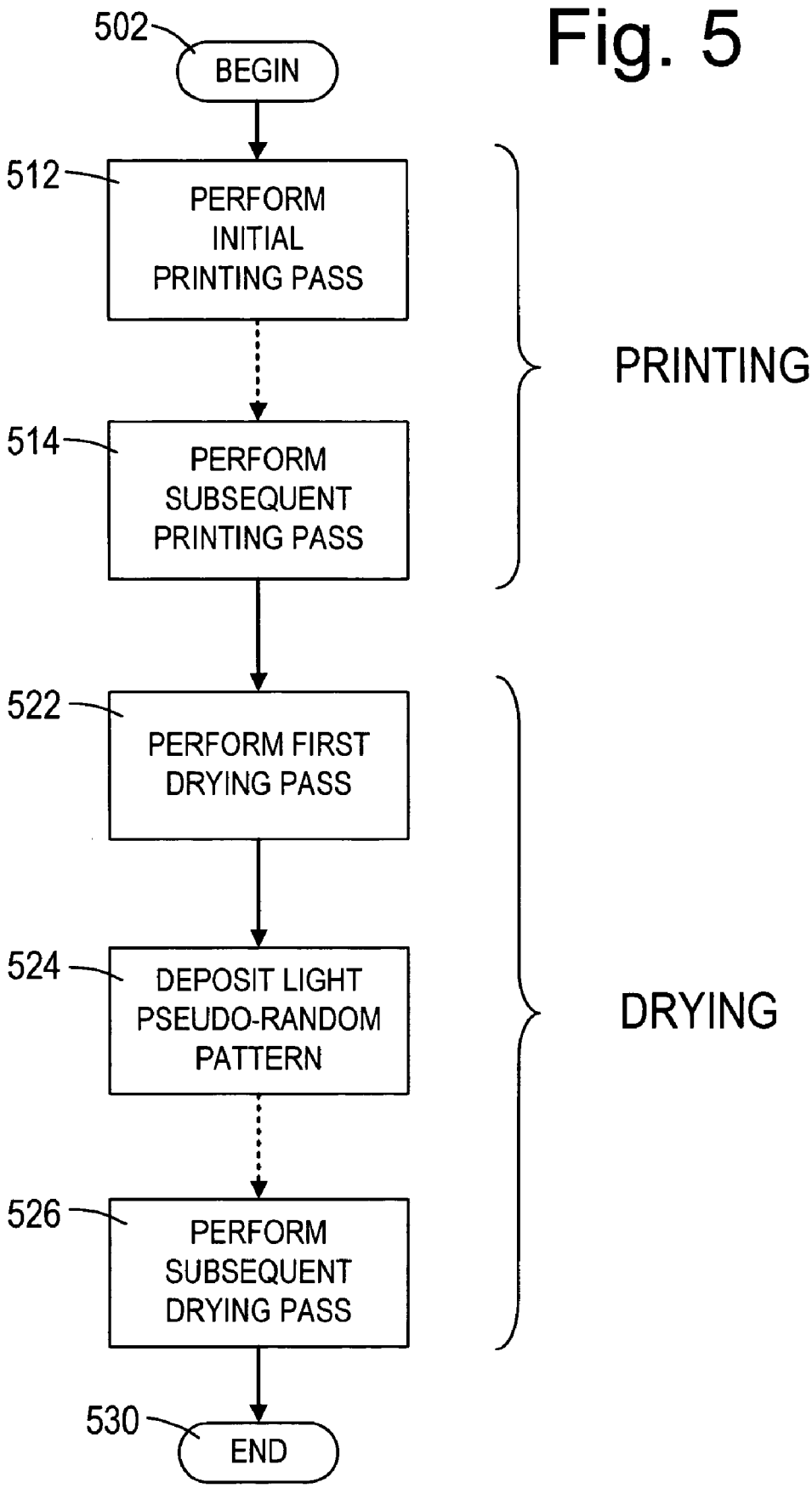
FIG. 5 is a flow chart further illustrating an embodiment of the present invention.

FIG. 5 is a flowchart summarizing the steps of an exemplary embodiment of the method of the present invention. The method begins 502 with an initial printing pass 512 during which a first portion of the image is deposited, followed by one or more additional printing passes 514 during which additional portions of the image are printed (as discussed above, multiple print passes allow for dense images to be printed without the problems of bleed or paper cockle). In a drum printer system, each printing pass typically involves a rotation of the drum, as the paper is moved past the printheads. After printing, a first drying pass 522 is performed, and deposition of the light pseudo-random pattern 524 serves to hide die boundary banding. The printing of the pseudo-random pattern may be performed on the same "pass" or drum revolution as the drying pass. A subsequent drying pass is performed 526, and the exemplary method ends 530.

In other embodiments, drying passes may be interspersed with printing passes, or only one printing pass or drying pass may be used. Similarly, the printing passes, printing of the light pseudo-random pattern 524, and drying passes may be performed in a different order than indicated in FIG. 5; also, the printing of the pseudo-random pattern may be done over several passes, rather than on a single pass.

An advantage of the present invention is that it allows the use of simple butt joints between die. Butt joints are the preferred method of combining multiple die for many reasons, not the least of which is their simplicity and ease of implementation. Being able to use a built joint between die gives developers fewer constraints during design.

A further advantage of embodiments of the invention is that potential print defects due to die boundaries may be avoided without additional hardware and without lengthening the overall print time. Repositioning of the printhead assemblies, such as required in an "indexing" solution, isn't required, and the very small amount of additional printing can be done during a print cycle utilized primarily for print drying. By performing the additional printing during what would normally be a drying cycle, there is no need to combine the print data of the additional printing with that of the normal printed image, thus simplifying print data computations.

By avoiding the "indexing" of the printhead assemblies, faster print times can be achieved. For example, in a test printer, the throughput when indexing the printhead assemblies was approximately 50 pages per minute, while the throughput without indexing was approximately 70 pages per minute (a performance gain of about 40%).

Printing of the light pseudo-random pattern (or patterns) typically utilizes available hardware and firmware of the printing system, such as the printer Application Specific Integrated Circuits (ASICs) utilized for halftoning and masking of the standard printed image.

Embodiments of the present invention may also be utilized to help conceal visible print defects between multiple printhead assemblies, such as indicated at 242 and 244 in FIG. 2. Further, embodiments of the present invention may be used in combination with other techniques to further conceal the joints between printhead die and improve print quality.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A method of hiding die-to-die boundary banding defects in an inkjet printing system, the printing system having at least one printhead assembly with multiple printhead die, the printhead assembly configured to be held substantially stationary and perpendicular to a media path during a printing pass, the method comprising:

printing an image on print media, and printing an additional small quantity of ink in a substantially random pattern for hiding die boundaries on the printed image at a different time than the printing of the image on print media.

2. The method of hiding die-to-die boundary banding defects in an inkjet printing system of claim 1, wherein the inkjet printing system comprises a drum printer.

3. The method of hiding die-to-die boundary banding defects in an inkjet printing system of claim 2, wherein printing is performed on multiple print passes, each print pass coincident with a drum rotation.

4. The method of hiding die-to-die boundary banding defects in an inkjet printing system of claim 3, wherein the printer is further configured to dry print media during at least one drum rotation, and wherein the printing of the additional small quantity of ink is performed simultaneous with the drying of the print media.

5. A printing system, comprising:

at least one printhead assembly with multiple printhead die, the printhead assembly configured to be held substantially stationary and perpendicular to a media path during printing;

a rotatable drum for retaining print media and moving the media past the at least one printhead assembly for printing;

a printer controller, the controller including firmware controlling printing of images on print media by the at least one printhead assembly; and the firmware further controlling the deposition of an additional small quantity of ink in a substantially random pattern for hiding die boundaries, wherein the firmware causes the deposition of the additional small quantity of ink in a substantially random pattern to occur at a different time than the printing of images on print media.

6. The printing system of claim 5, wherein the firmware causes the printing of images on print media to be performed over several rotations of the rotatable drum, with a portion of an image deposited on each drum rotation.

7. The printing system of claim 6, wherein the firmware further controls drying of printed media, the drying occurring during at least one rotation of the rotatable drum.

8. The printing system of claim 7, wherein the firmware causes the deposition of the small additional quantity of ink in a substantially random pattern to occur during a rotation of the rotatable drum that is substantially utilized for drying of the printed media.

9. A printing system, comprising:

at least one printhead assembly with multiple printhead die, the printhead assembly configured to be held substantially stationary and perpendicular to a media path during printing;

a rotatable drum for retaining print media and moving the media past the at least one printhead assembly for printing;

means for controlling the printing of images on print media by the at least one printhead assembly; and means for the deposition of an additional small quantity of ink in a substantially random pattern for hiding die boundaries at a different time than the printing of the images on print media.

10. A method of hiding light banding defects in printed images caused by die-to-die boundaries of a printhead assembly in a drum based inkjet printing system, comprising:

on at least one rotation of a drum retaining print media, printing an image on print media; and on at least one other rotation of the drum, depositing a light substantially random pattern of ink for hiding die boundaries at a different time than the printing of the image on print media.

11. The method of claim 10, wherein printing is performed by at least one printhead assembly having multiple printhead die, the printhead assembly held substantially stationary and substantially perpendicular to the print media retained by the drum as the print media is rotated past the at least one printhead assembly.

12. The method of claim 10, further comprising drying the image.

13. The method of claim 12, wherein depositing the light substantially random pattern of ink occurs during a first time interval and the drying of the image occurs during a second time interval, the first time interval and second time interval overlapping.

14. The method of claim 12, wherein depositing the light substantially random pattern of ink occurs during a first time interval and the drying of the image occurs during a second time interval, the first time interval substantially contained within the second time interval.

15. A printing system, comprising:

a plurality of printhead assemblies, each printhead assembly having multiple printhead die, the printhead assemblies configured to be held substantially stationary and perpendicular to a media path during printing;

a rotatable drum for retaining print media by air suction and moving the media past the plurality of printhead assemblies for printing;

a printer controller, the controller including firmware controlling printing of images on print media by the plurality of printhead assemblies; and the firmware further controlling the deposition by the plurality of printhead assemblies of an additional small quantity of ink in a substantially random pattern for hiding die boundaries, wherein the firmware causes the deposition of the additional small quantity of ink in a substantially random pattern to occur at a different time than the printing of images on print media.

16. The printing system of claim 15, wherein the firmware causes the printing of images on print media to be performed over several rotations of the rotatable drum, with a portion of an image deposited on each drum rotation.

17. The printing system of claim 16, wherein the firmware further controls drying of printed media, the drying occurring during at least one rotation of the rotatable drum.

18. The printing system of claim 17, wherein the firmware causes the deposition of the small additional quantity of ink in a substantially random pattern to occur during a rotation of the rotatable drum that is substantially utilized for drying of the printed media.

19. A method of hiding printhead assembly to printhead assembly boundary banding defects in an inkjet printing system, the printing system having at least two printhead assemblies, the at least two printhead assemblies configured to be held substantially stationary and perpendicular to a media path during a printing pass, the method comprising:

printing an image on print media, and printing an additional small quantity of ink in a substantially random pattern for hiding die boundaries on the printed image at a different time than the printing of the image on print media.

20. The method of hiding printhead assembly to printhead assembly boundary banding defects in an ink jet printing system of claim 19, wherein the ink jet printing system comprises a drum printer.

21. The method of hiding printhead assembly to printhead assembly boundary banding defects in an inkjet printing system of claim 20, wherein printing is performed on multiple print passes, each print pass coincident with a drum rotation.

22. The method of hiding printhead assembly to printhead assembly boundary banding defects in an inkjet printing system of claim 21, wherein the printer is further configured to dry print media during at least one drum rotation, and wherein the printing of the additional small quantity of ink is performed simultaneous with the drying of the print media.

23. A printing system, comprising:

at least two printhead assemblies with multiple printhead die, the printhead assemblies configured to be held substantially stationary and perpendicular to a media path during printing;

a rotatable drum for retaining print media and moving the media past the at least one printhead assembly for printing;

a printer controller, the controller including firmware controlling printing of images on print media by the at least two printhead assemblies; and the firmware further controlling the deposition of an additional small quantity of ink in a substantially random pattern for hiding die boundaries, wherein the firmware causes the deposition of the additional small quantity of ink in a substantially random pattern to occur at a different time than the printing of images on print media.

24. The printing system of claim 23, wherein the firmware causes the printing of images on print media to be performed over several rotations of the rotatable drum, with a portion of an image deposited on each drum rotation.

25. The printing system of claim 24, wherein the firmware further controls drying of printed media, the drying occurring during at least one rotation of the rotatable drum.

26. The printing system of claim 25, wherein the firmware causes the deposition of the small additional quantity of ink in a substantially random pattern to occur during a rotation of the rotatable drum that is substantially utilized for drying of the printed media.

27. A printing system, comprising:

at least two printhead assemblies with multiple printhead die, the printhead assemblies configured to be held substantially stationary and perpendicular to a media path during printing;

a rotatable drum for retaining print media and moving the media past the at least one printhead assembly for printing;

means for controlling the printing of images on print media by the at least one printhead assembly; and means for the deposition of an additional small quantity of ink in a substantially random pattern for hiding die boundaries at a different time than the printing of the images on print media.

28. A method of hiding light banding defects in printed images caused by printhead assembly to printhead assembly boundaries in a drum based inkjet printing system, comprising:

on at least one rotation of a drum retaining print media, printing an image; and on at least one other rotation of the drum, depositing a light substantially random pattern of ink for hiding die boundaries at a different time than the printing of the image on print media.

29. The method of claim 28, further comprising drying the image.

30. The method of claim 29, wherein depositing the light substantially random pattern of ink occurs during a first time interval and the drying of the image occurs during a second time interval, the first time interval and second time interval overlapping.

31. The method of claim 29, wherein depositing the light substantially random pattern of ink occurs during a first time interval and the drying of the image occurs during a second time interval, the first time interval substantially contained within the second time interval.

* * * * *

UNITED STATES PATENT AND TRADEMARK OFFICE

CERTIFICATE OF CORRECTION

PATENT NO. : 7,434,911 B2
APPLICATION NO. : 11/044123
DATED : October 14, 2008
INVENTOR(S) : Michael Brookmire et al.

It is certified that error appears in the above-identified patent and that said Letters Patent is hereby corrected as shown below:

In column 5, line 60, delete “built” and insert -- butt --, therefor.

In column 8, line 44, in Claim 20, delete “ink jet printing” and insert -- inkjet printing --, therefor.

In column 8, line 45, in Claim 20, delete “ink jet printing” and insert -- inkjet printing --, therefor.

Signed and Sealed this

Thirty-first Day of March, 2009

JOHN DOLL
*Acting Director of the United States Patent and Trademark Office*